United States Patent [19]

Bettendorf et al.

[11] Patent Number: 4,852,785

[45] Date of Patent: Aug. 1, 1989

[54] PRINTER PAPER CONTROL APPARATUS AND METHOD

[75] Inventors: Richard A. Bettendorf; Scott S. Morris, both of Oklahoma City, Okla.

[73] Assignee: Honeywell Bull Inc., Minneapolis, Minn.

[21] Appl. No.: 124,695

[22] Filed: Nov. 24, 1987

[51] Int. Cl.[4] ..... B65H 23/18; B65H 59/18

[52] U.S. Cl. ..... 226/42; 242/75.51; 101/181

[58] Field of Search ..... 242/75.45, 75.47, 75.51, 242/75.3; 226/24, 25, 40–45, 111, 195; 318/6, 7; 101/181, 182

[56] References Cited

U.S. PATENT DOCUMENTS

| | | | |
|---|---|---|---|
| 3,257,086 | 6/1966 | Drenning | 242/75.47 |
| 3,539,085 | 11/1970 | Anderson et al. | 226/25 |
| 3,561,654 | 2/1971 | Greiner | 226/25 |
| 3,713,600 | 1/1973 | Murray et al. | 242/75.51 X |
| 4,007,866 | 2/1977 | Traise | 226/31 |
| 4,417,516 | 11/1983 | Fischer | 101/181 |
| 4,658,723 | 4/1987 | Tokuno et al. | 101/181 |

*Primary Examiner*—Stuart S. Levy
*Assistant Examiner*—Steven M. duBás
*Attorney, Agent, or Firm*—John S. Solakian

[57] ABSTRACT

Motor control apparatus is described that is used in a printer that prints on a paper web coming from a roll of paper and has two-sided printing capability using two print mechanisms. The motor control apparatus controls power to several DC motors that either move the paper web from a roll through the printer or provide back tension to the paper web. The control circuits sense paper travel speed and motor loading and thereby sense the effects on paper tension caused by others of the control circuits. The interaction of motor torques provided by the control circuits maintains constant tension on the paper web throughout the printer and thereby assures that there is front to back printing registration on each two-sided printed sheet, and also assures that there is top to bottom centering registration of printing on each sheet of paper when the paper web is cut into individual sheets of paper.

11 Claims, 3 Drawing Sheets

PRINTER PAPER CONTROL APPARATUS AND METHOD

FIELD OF THE INVENTION

This invention relates to printers and more particularly to paper tension control in a printer using a roll of paper to print on.

BACKGROUND OF THE INVENTION

In the prior art there are many types of printers that are used with data processing equipment. Examples of such prior art printers are impact printers which include daisy wheel and dot matrix printers, and laser printers which use a copier process coupled with a laser that writes the material to be printed to an image drum within the printer. There are also many other types of prior art printers. Such prior art printers usually utilize sheet paper.

Paper handling mechanisms for high-speed sheet paper printers are typically very complex and very expensive. To reduce the complexity and cost some high-speed prior art printers utilize a roll of paper that passes through the printer mechanisms as one continuous web and, after printing is accomplished, the paper is cut into sheets and is output either directly from the printer or is output via prior art collator mechanisms. There have been problems with these prior art roll paper printers in that the tension on the paper web is varied throughout the printer mechanisms caused by the mechanisms starting and stopping, and by different pressures being applied to the paper by drive rollers. The result has been variable elongation of the paper web. The result of variable elongation of the paper web with two sided printing being performed is a misregistration of the print on both sides of the paper. In addition, the paper cutting mechanism found in such printers has not been able to be operated properly to cut the paper into sheets. That is, printing on each sheet after cutting the web is not vertically positioned properly. The printing is near the top of a sheet, near the bottom of a sheet, and sometimes properly positioned vertically in the middle of a sheet. These problems have all contributed to preventing roll paper printers from becoming popular.

Accordingly, there is a need in the art for a roll paper printer that can regulate the tension on the paper web and keep it uniform as it passes through the mechanisms in the printer. This greatly reduces the prior art problems enumerated above.

SUMMARY OF THE INVENTION

The above stated needs of the prior art are met by the novel printer roll paper control apparatus and method disclosed and claimed herein. The basic printer in which the invention is used has a relatively simple paper handling mechanism, is modular, and can be easily and quickly converted from a one-sided printer to a two-sided printer at minimal expense. In addition, this basic printer performs front and backside printing at the same time to speed up the printing process while avoiding the need for a complex paper handling mechanism to perform two-sided printing as is required in the prior art.

The novel paper control apparatus has paper travel speed sensors, load sensors and control circuitry that regulate power being applied to drive and tension motors throughout the printer mechanisms to keep tension on the paper web relatively constant throughout. The constant tension stabilizes forces on the paper web and thereby stabilizes elongation of the paper web. This improves front to back print registration, and vertical print position registration to provide two sided copies that are consistently as good as those obtained from a sheet paper printer.

DESCRIPTION OF THE DRAWING

The invention will be better understood upon reading the following detailed description in conjunction with the drawing in which.

DETAILED DESCRIPTION

Figure 1:
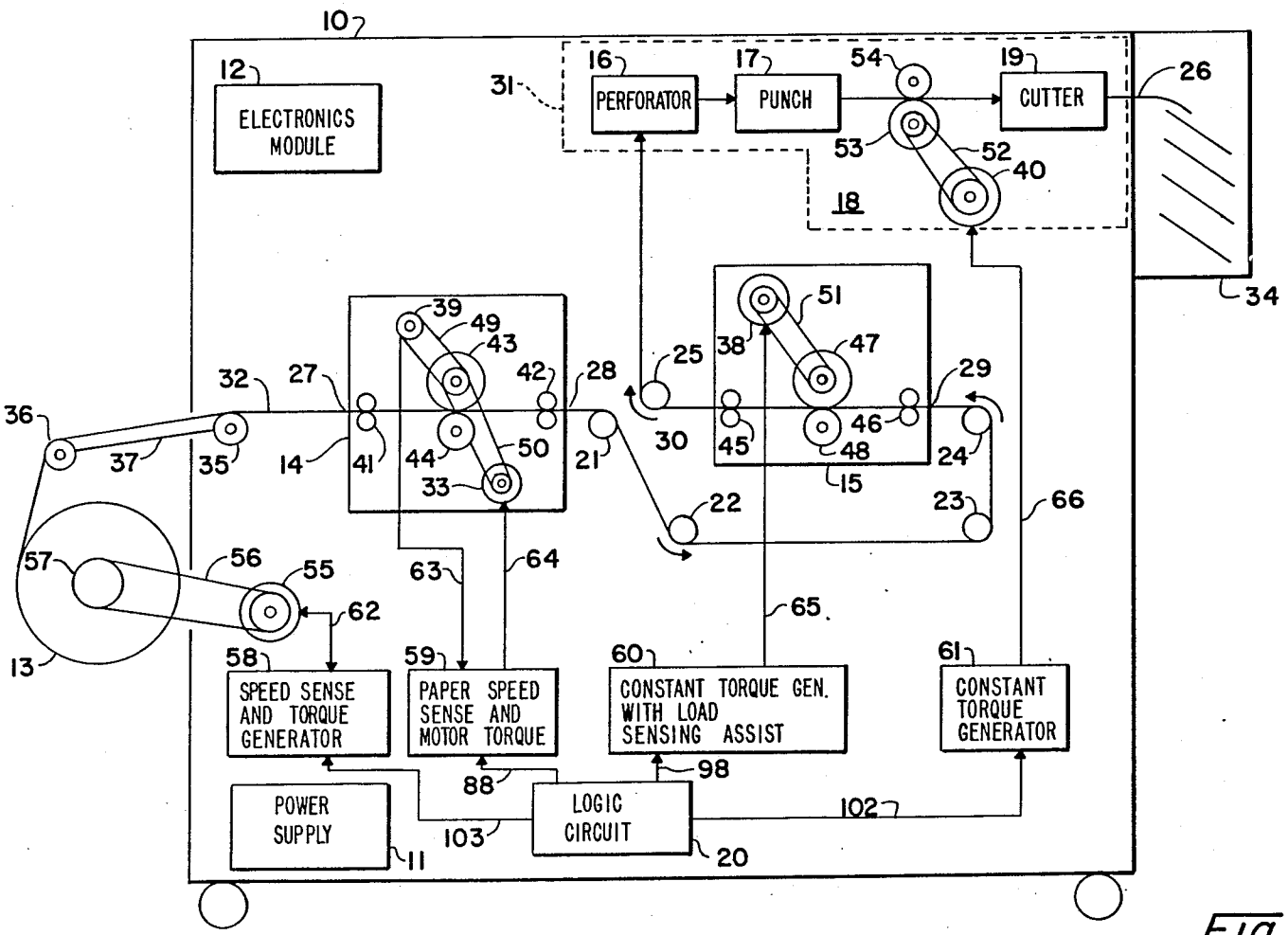
FIG. 1 is a front view of the inside of a roll paper printer housing containing the basic printer with simple paper handling mechanism and showing in block diagram form the sensors and control circuitry of the present invention that regulate the speed of drive and other motors of the printer.

In FIG. 1 is seen a front view of a printer housing 10 in which are located a number of modules that make up the printer. Located in the bottom of housing 10 is a power supply 11 that is connected to AC power (not shown) and provides the DC and AC power to all the other modules inside of housing 10. Supply 11 may conveniently be made up of a number of smaller modular power supplies (not shown) that may be easily accessed for maintenance or replacement. The power supply is heavy and by mounting it in the bottom of housing 10 the center of gravity of the printer is lowered for safety considerations.

There is an electronics module 12 mounted at the top left of housing 10 where it is easily accessible from the top for testing, maintenance and replacement. Module 12 is not shown in any detail since its function and makeup are well known in the art, but advantageously uses plug in printed circuit cards. The printed circuit cards are easily and quickly replaced to speed up maintenance and repairs, and also permits easy, fast upgrading of the electronics. Electronics module 12 has the logic that basically controls all the other modules inside of housing 10, and receives, stores, and initially processes the electronic signals that indicate the alphanumeric and other images to be printed.

The printer described herein preferably uses a roll of paper 13 that is to be printed on, rather than using discrete sheets of paper from a sheet feeder. The use of a roll of paper 13 simplifies the handling of paper web 32 between the modules inside of printer housing 10. In FIG. 1 paper roll 13 is shown mounted external to printer housing 10 for ease of replacing the paper roll. External mounting is the preferred embodiment of the invention and permits large diameter paper rolls to be used, but paper roll 13 may alternately be mounted internal to printer housing 10. With the alternate internal mounting only smaller diameter rolls of paper may typically be used.

Also mounted inside of housing 10 are two modular printing mechanisms 14 and 15. These printing mechanisms are known in the art and are advantageously ion projection or electrographic printing mechanisms, but may also be other printing mechanisms known in the art. Because such printing mechanisms are so well known in the art they are only described very briefly herein to avoid detracting from the description of the invention. Electrographic printing mechanisms are basically comprised of a copier mechanism which uses a special coated drum on which the image to be printed is created as an electrostatic image which is then developed using a dry or wet toner. The toner image is then transferred to sheet or roll paper passing through the mechanism and is then fixed thereon by a number of means including heat. To create the image to be printed on the drum a laser beam is deflected over the surface of the drum responsive to electronic signals which indicate the alphanumeric and other images that are to be printed on the paper. As is known in the art an almost infinite range of images and characters may be printed with a laser printer coupled to a microprocessor arrangement. The cooperation of printing mechanisms 14 and 15 to perform two-sided and one-sided printing is described further in this specification.

Mounted inside of printer housing 10 are also other well known modules needed to handle roll paper. They are a perforator 16 used to perforate the paper at the point at which a sheet is to be formed, a punch mechanism 17 used to punch round holes through the edge of each copy sheet for mounting the sheets in three ring binders, a drive station 18, and a paper cutter 19 for cutting the roll paper into individual sheets. Modules 16, 17, 18 and 19 are preferably mounted on a subchassis 31 for ease of removal for maintenance and replacement Individual cut sheets of paper printed on one or both sides leave cutter 19, exit printer housing 10 at exit 26 and are collated or otherwise stacked by an external stacking assembly 34 in a manner well known in the art.

In operation of the printer, paper web 32 from paper roll 13 first passes around a roller 36 at the end of splice station 37. Station 37 is the point at which the paper at the beginning of a new roll paper is spliced to the end of a just depleted roll of paper (not shown). This is done so that the new roll of paper need not be rerouted through the mechanisms inside printer 10. Paper web 32 then enters the printer housing 10 and passes over roller 35. Just before paper on roll 13 is depleted, an end of roll indication is detected by a sensor (not shown) which provides a signal to electronics module 12 that causes the printer to stop, and a paper roll replace signal to be given until an empty paper roll 13 is replaced with a new roll of paper. The end of the depleted roll is spliced to the beginning of a new roll at splice station 37 as previously mentioned.

The paper web 32 from roll 13 enters the first modular printer mechanism 14 at input 27 and alphanumeric characters and other images are printed on a first or front side of the paper in a manner well known in the art. The paper then leaves printer mechanism 14 at exit 28, and passes over a first paper handling means comprising rollers 21, 22, 23 and 24 to input 29 of the second modular printer mechanism 15. By orienting second printer mechanism 15 with its input 29 to the right and passing the paper around to input 29, the paper is inverted so that the second or backside thereof may be printed thereon in printer mechanism 15 to provide two-sided printing. The paper exits second printer mechanism 15 at exit 30, passes around a second paper handling means comprising roller 25 and enters perforator 16 on subchassis 31. After passing through perforator 16, punch 17, drive 18 and cutter 19, individual sheets of paper printed on both sides are output from printer housing 10 at exit 26. Printed sheets of paper exiting printer housing 10 enter stacking mechanism 34 which collates or otherwise stacks the printed sheets of paper in a manner well known in the art. Because paper collating and stacking mechanisms are so well known in the art, stacking assembly 34 is not disclosed in any further detail herein to avoid detracting from the description of the invention.

Processing modules 16, 17, 18, and 19 are preferably mounted on a single subchassis 31 so each module may easily be removed as a unit for maintenance or replacement. This also helps provide relatively easy access to printer mechanisms 14 and 15 for cleaning, adjustment, removal, replacement, and installation.

With printer mechanisms 14 and 15 respectively providing the front side and backside printing on the paper, it is obvious that there is a time delay between printing the front side and printing the backside of the paper. When only a single sheet of paper is being printed on both sides by the printer, there is not much savings in printing time However, when a large number of sheets are being printed there is an appreciable savings in printing time. After the front or first side of a first sheet is printed in printer mechanism 14, its backside or second side is printed in printer mechanism 15 at the same time that the front side of another sheet is being printed in printer mechanism 14. This simultaneous two-sided operation increases the printing speed of the printer.

When a customer wants a simpler printer configuration capable of only one-sided printing, printer mechanism 15 is not installed and the paper exiting first printer mechanism 14 at exit 28 is routed to pass around roller 25 and go directly to perforator 16. The paper does not pass around rollers 21, 22, 23 and 24 for one-sided printing with this configuration of the printer. Even if the printer is equipped with both printer mechanisms 14 and 15 for two-sided printing, paper web 32 from roll 13 may still be routed as just described in the last two sentences when one sided printing is all that is desired, or second printer mechanism 15 is malfunctioning. Selectively, one sided printing may still be done by having only one of the two printing mechanisms 14 or 15 operated. This capability is implemented by operating switches in electronics module 12 to select the routing and timing of images signals to the one of printing mechanisms 14 or 15 that is selected to do the one-sided printing in a manner known in the art. This capability extends the usefulness of the printer by permitting the printer to be used for one-sided printing after one of the printing mechanisms 14 or 15 has become defective and in need of repair or replacement.

After a one-sided printer configuration has been installed for a customer, the customer may change their mind and the second printer mechanism 15 may be quickly and easily installed at the customer's site. The customer need not change printers or add a second printer as must presently be done in the art. This flexibility is created because of the novel physical orientation of rollers 21, 22, 23 and 24, printer mechanisms 14 and 15 and the simple paper handling that is provided by the rollers. As a result of this simple, inexpensive paper handling arrangement the paper handling mechanisms need not be physically modified in any way to perform one-sided or two-sided printing.

The novel paper control apparatus controls power to drive motors in the printer that move paper web 32 through the printer. The motors are motors 55, 33, 38 and 40. These motors have the power applied to them controlled by circuits 58, 59, 60 and 61 which are described in detail hereinafter with reference to FIGS. 2 and 3.

Paper roll 13 is mounted and automatically secured to a free turning spindle or axle 57 which is mechanically coupled to motor 55. That is, paper roll 13 cannot rotate separate from spindle 57. Motor 55 has a pulley on its drive shaft, and the power from motor 55 is coupled to spindle 57 via belt 56. There are many types of belts and gear drives known in the art so it is not discussed in any further detail. Motor 55 is a DC motor that is energized via leads 62 by speed sense and torque generator 58. The power that control circuit 58 applies to DC motor 55 applies a counter-clockwise torque on its output shaft, and to spindle 57 via drive belt 56. This counter-clockwise active torque is applied to paper roll 13 to source of web to rewind 321 or take up any slack in the paper before the other motors in the printer are energized, and to produce a constant tension, or force on paper web 32 opposing movement of web 32 through printers 14,15 and subchassis 31 as the paper on roll 13 is used up. This rewind torque is of a low enough level that it does not cause paper web 32 to be pulled back through the two printer mechanisms, or work stations 14,15 and subchassis, or work station, 31 due to the high friction, or frictional forces of work stations 14,15 and 31 acting on web 32. As the printer operates and paper is used, the shaft of motor 55 turns clockwise despite its counter-clockwise torque, and thereby provides an indication to circuit 58 that paper web 32 has not been broken or that there is no more paper on roll 13. If there is a break in paper web 32, or the paper has been deleted, motor 55 will start to turn counter-clockwise. This is sensed by circuit 58 which signals the other circuits 59, 60 and 61 to turn off power to their respective motors 33, 38 and 40. In this manner, when paper on roll 13 has been deleted, power to all motors is terminated before the end of paper web 32 is pulled through the printer, and the paper from a new roll of paper must then be threaded through all the printer mechanisms. This is a time consuming and tedious task. With power being terminated immediately the tail end of paper web 32 remains external to printer housing 10 and may easily be spliced to the front end of a new roll of paper placed on spindle 57 at splice station 37. The printer is then started up again and printing is resumed.

Paper web 32 enters first print mechanism 14 between guide rollers 41, then passes between image transfer drum 43 and pressure roller 44, and finally exits print mechanism 14 between guide rollers 42. Pressure roller 44 is semi-resilient and pushes paper web 32 tightly against image transfer drum 43. As drum 43 is turned paper web 32 is pulled through first printer mechanism 14. Motor 33 is a DC drive motor that has a pulley on its shaft. Image transfer drum 43 also has a pulley on its shaft, and there is a drive belt 50 between these two pulleys. As motor 33 turns counter-clockwise, image transfer drum 43 likewise turns counter-clockwise and paper web 32 is pulled to the right through printer mechanism 14. There is also another belt 49 coupled to the shaft of image transfer drum 43 via a pulley. Belt 49 is coupled via another pulley to the shaft of an incremental encoder 39. The incremental encoder produces a pulse at its output for each predetermined increment of paper travel. The output of incremental encoder 39 provides a feedback signal which is connected via lead 63 to a paper speed sense and motor torque circuit 59. Circuit 59 senses the linear travel speed of paper web 32 from the output from encoder 39 and adjusts the power it applies to DC motor 33 via leads 64 to maintain a precise set, or predetermined speed.

The pulses from the output of incremental encoder 39 are also counted and, when a predetermined count is reached, causes initiation of printing by second printer mechanism 15. The time that this predetermined count is reached is when the back side of a portion of the paper web that has just been printed on its front side, and that is to be printed on both sides, is inside second printer mechanism 15.

Paper web 32 enters second print mechanism 15 between guide rollers 46, then passes between image transfer drum 47 and pressure roller 48, and finally exits print mechanism 15 between guide rollers 45. Pressure roller 48 is semi-resilient and pushes paper web 32 tightly against image transfer drum 47. As drum 47 is turned paper web 32 is pulled through second printer mechanism 15. Motor 38 is a DC drive motor that has a pulley on its shaft. Image transfer drum 47 also has a pulley on its shaft and there is a drive belt 51 between these two pulleys. As motor 38 turns clockwise image transfer drum 47 likewise turns clockwise and paper web 32 is pulled to the left through printer mechanism 15.

Motor 38 is powered by constant torque generator and load sensing assist circuit circuit 60 to apply a constant torque to DC motor 38. The goal of the motor control being accomplished by circuits 60 and 61 is constant tension in paper web 32. However, due to high pressure between the drive/pressure rollers and the image transfer drums in the two print stations, there is a variation in the friction of paper web 32 with drums 43 and 47. The variation in friction translates to a change in tension applied to paper web 32. Since the power applied to motor 33 is equal to its internal friction plus the tension of spindle 57 and minus printer mechanism 15 tension, a high friction in printer mechanism 15 reduces the tension on paper web 32 and forces control circuit 59 to increase the power applied to motor 33. Control circuit 60 senses the increased power of motor 33 and adds a proportional amount of power to motor 38 to partially correct for the change in tension caused by the variation in friction. This load sensing is done by load sensing assist circuitry in control circuit 60 and reduces the variation in paper web tension between the two print mechanisms 14 and 15. The end result is that there is good registration between front side and back side paper printing, and the registration of the paper when it is cut at cutter 19 is improved.

After paper web 32 exits second printer mechanism 15, it is pulled by paper drive 18 in subchassis, or work station, 31. Paper drive 18 comprises rollers 53 and 54, and motor 40. Motor 40 has a pulley on its shaft and is coupled via a drive belt 52 to a pulley on the shaft of roller 53. Thus, motor 40 drives roller 53. Rollers 53 and 54 tightly pinch paper web 32 to apply force to it and pull the paper web. Motor 40 is a DC motor that operates in a constant torque mode with fixed current from constant torque generator circuit circuit 61 via lead 66. Thus, the tension in paper web 32 as it passes through perforator 16, punch 17, and drive 18 remains constant. The result is that paper web 32 may be accurately cut at cutter 19 to have proper vertical print registration on the individual sheets of cut paper. As mentioned previously, the cut sheets of paper exit housing 10 at exit 26 and are collated by collator 34.

In operation, when the printer is turned on, timing of applying power to the motors is such that power is first applied to back tension motor 55, then power is applied to motor 40. At this point there is tension on paper web 32 before first printer mechanism 14 and after second printer mechanism 15. Paper web does not yet move due to the high frictional forces primarily from printer mechanisms 14 and 15. Next power is applied to motor 38 in second printer mechanism 15 and tension is thereby applied to the paper web 32 between mechanisms 14 and 15. However, the torque applied to DC motor 38 is not enough to cause paper web 32 to move yet. The paper web 32 does have its normal run tension applied to it at this time and the printer is ready to start. Finally, movement of the paper web through the printer mechanisms is controlled by motor 33 which is the last motor to have power applied to it. Power is applied to motor 33 in a smooth, increasing manner (ramp function) to bring the paper web 32 up to its normal travel, or operating speed through the printer. The other motors maintain their torque levels to keep a constant tension on web 32. Just before the paper web speed is at its operating speed, the power applied to motor 55 that is connected to the paper roll 13 spindle 57 is switched from rewind power to its controlled run tension. At this point motor control circuits 58, 59, 60 and 61 function to maintain constant paper web speed and tension. Print functions now take place in a manner well known in the art, so they are not described herein.

If a paper break, paper outage, paper jam, loss of web speed, or motor overcurrent is detected, it will cause the printing process to be interrupted. At the end of a printing job power is simultaneously interrupted to DC torque motors 33, 38 and 40. Power remains applied to motor 55 and its torque helps to bring the system to a smooth halt with little slack in paper web 32. After paper web 32 travel stops, power is interrupted to motor 55.

Figure 2:
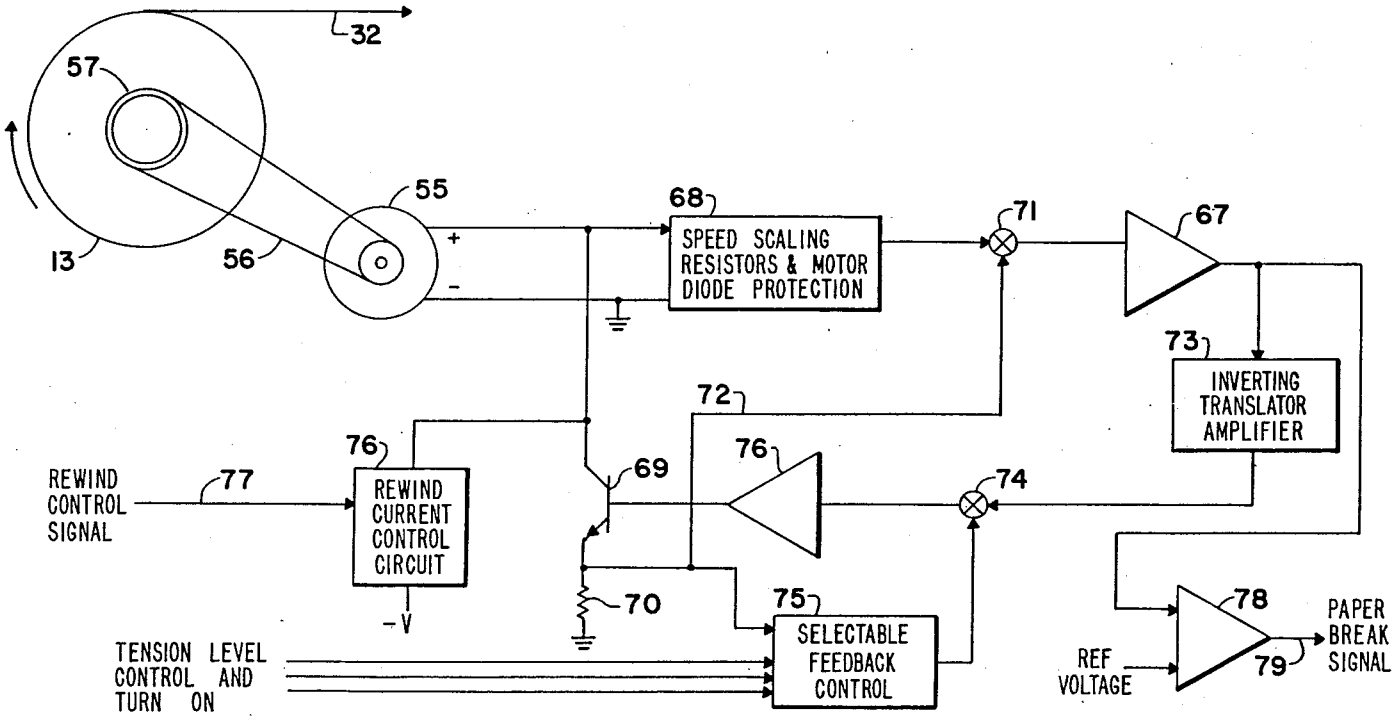
FIG. 2 is block diagram schematic of control circuitry that provides constant back tension to paper coming from a feed roll of paper to the printer.

In FIG. 2 is shown a detailed block diagram of the circuitry of speed sense and torque generator circuit 58. As can be recognized the tension applied to paper web 32 varies with a constant torque being applied to spindle 57 due to the diameter of paper roll 13. The circuitry computes and compensates for the diameter of paper roll 13 using the principle that a DC motor generates an output voltage proportional to its rotational speed. The circuitry uses this generated voltage to vary the DC current applied to motor 55 to maintain a constant tension on paper web 32. To state it another way, as the paper is used from roll 13 at a constant linear rate, spindle 57 and motor 55 are turning at a rate dependent on the diameter of the paper roll at each point in time. The ratio of motor speed to paper roll diameter is a parabolic function and is converted to a direct ratio in linearization amplifier 67.

In block 68 there are diodes (not shown) that are connected across the winding of motor 55 to prevent damage to the circuitry caused by turning motor 55 in reverse. In addition, in block 68 there are also a bank of scaling resistors (not shown) that are jumper selectable, and are jumpered for different selected motor operating speeds.

Since linearization circuit 67 is detecting an output voltage from motor 55 to determine the diameter of paper roll 13, any current through motor 55 reduces the detected voltage by the current times the internal winding resistance of the motor. All current caused by the voltage being detected, except for a few milliamps going through the scaling resistors in block 68, flows through transistor 69 and a current sensing resistor 70. The voltage drop across sensing resistor 70 is input to summing circuit 71 via lead 72. The voltage across sensing resistor 70 is summed with the scaled voltage output from the scaling resistors (not shown) in block 68 to provide a true level of the generated voltage from motor 55 as an input to linearization amplifier 67.

The power required to be applied to motor 55 to produce a constant tension on paper web 32 is directly proportional to the radius of the remaining paper on paper roll 13, and thus inversely proportional to the linearized speed voltage. The output from linearization amplifier 67 is input to inverting translator amplifier which inverts the signal so that it is directly proportional to the linearized speed voltage signal. The inverted signal output from inverting amplifier 73 is summed in summing circuit 74 with a selectable feedback signal from selectable feedback control circuit 75 to produce a control signal which is input to current amplifier 76. The output from current amplifier 76 is connected to the base of power transistor 69 which is turned on and allows drive current flowing through motor 55 to flow through sensing resistor 70. The voltage across sensing resistor 70 is also input to selectable feedback control circuit 75, the output of which is input to summer circuit 74. Circuit 75 consists of several FET switches that control inputs from several tension level control logic control lines and also an on-off signal. The level control signals are used to program the amount of back tension to be applied to paper web 32 via power being applied to motor 55. The on-off signal is used to inhibit any power from being applied to motor 55.

A negative power source is input to rewind current control circuit 76, which is basically a switch that is operated by a rewind control signal on lead 77, to apply reverse current to motor 55 that will cause a rewind torque to be generated by the motor. The rewind control signal is generated by a logic circuit (not shown) that controls the sequencing of the different DC torques motors as described previously in this specification.

There is also a two input comparator 78 that has at one input the linearized speed signal output from amplifier 67, and the other input a reference voltage. When there has been a breakage of the paper web, or paper on paper roll 13 is depleted, spindle 57 stops and begins to turn counterclockwise instead of clockwise. This is sensed by comparator 78 which provides an output signal on lead 79 indicating the breakage or running out of paper.

Figure 3:
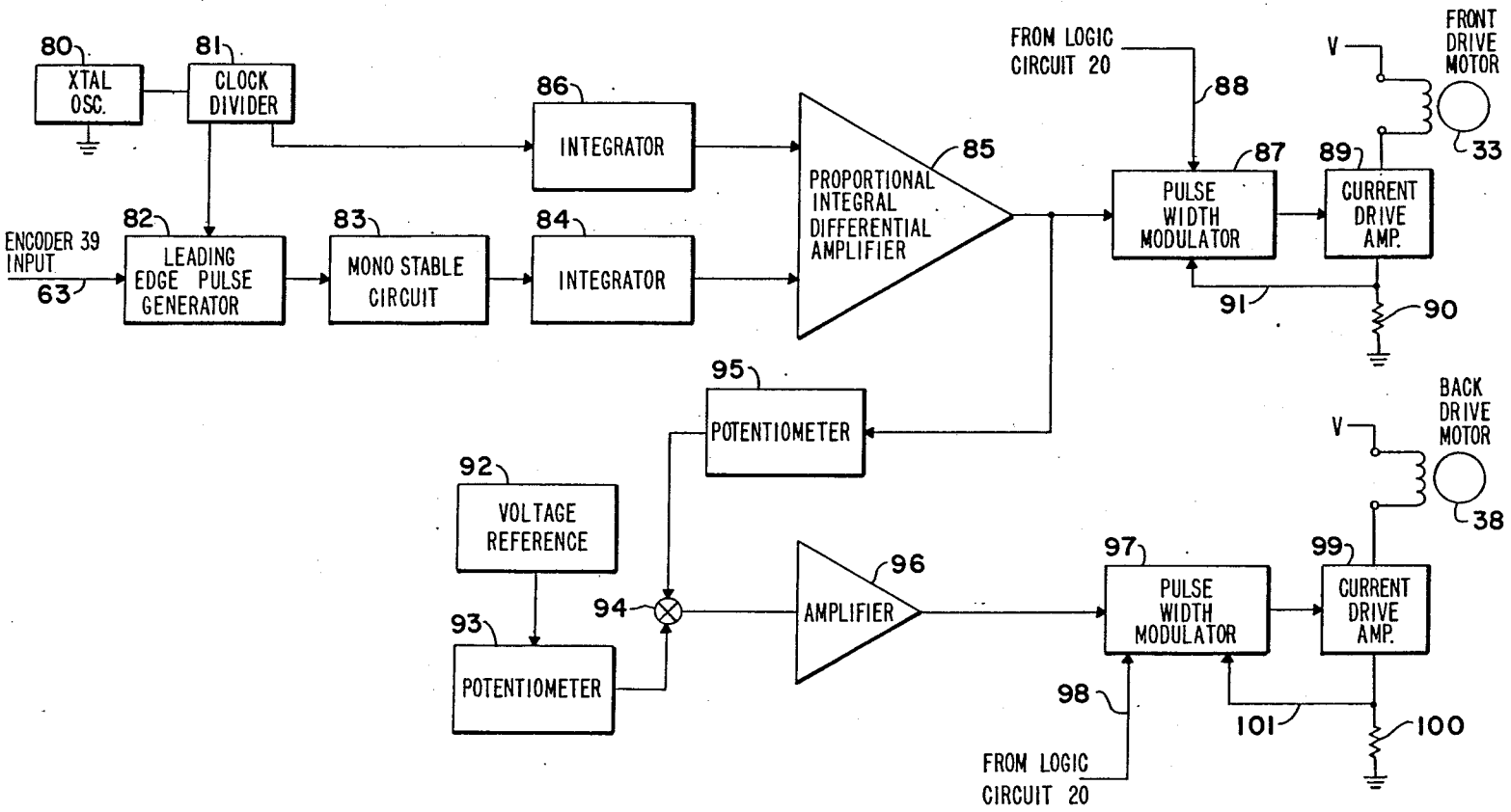
FIG. 3 is a block diagram schematic of paper speed control and constant motor torque control circuits that maintains constant tension on the paper web and that moves the paper web at constant speed through the printer.

In FIG. 3 is shown a combined detailed block diagram schematic of paper speed sense and motor torque circuit 59 and constant torque generator with load assist circuit 60, both shown in FIG. 1. As previously mentioned, paper speed sense and motor torque generator 59 controls motor 33 in the first print mechanism 14, and constant torque generator with load assist circuit 60 controls motor 38 in the second print mechanism 15.

The speed control of motor 33 is basically set by quartz crystal oscillator 80, the output of which is divided down by clock divider 81. One divided output from divider 81 is input to leading edge pulse generator 82 which also has the pulse output on lead 63 from incremental encoder 39 in FIG. 1. The pulses output from encoder 39 are a feedback indicating the speed of motor 33. Generator 82 responds to the rising leading edge of each pulse output from incremental encoder 39 and to the clock signals from clock divider 81 to generate a narrow pulse for each pulse from encoder 39. The narrow pulses output from generator 82 are applied to, and each pulse triggers monostable circuit 83 which is a monostable multivibrator. The result is a series of precise pulses that are input to and integrated by counter 84 to produce a DC voltage. The DC output from integrator 84 is one of two inputs to a proportional integral differential amplifier 85. There is a second output from clock divider 81 that has a lower frequency than the output to pulse generator 82. This lower frequency output is input to integrator 86 which integrates same and produces a DC reference voltage at its output. The DC reference voltage output from integrator 86 is also input to differential amplifier 85. Amplifier 85 is made up of two differential amplifiers, a first of which is a proportional stage having fast response, and the second of which is an integral stage having high gain but an integrated output for lower frequency response. This provides a more precise overall speed regulation. Differential amplifier 85 compares the two DC voltages at its two inputs and provides an output signal which is the difference between the two DC voltages.

The output signal from differential amplifier 85 is a speed error signal for motor 33 and is input to pulse width modulator 87. The feedback speed error signal output of the integral differential amplifier is disabled until the printer is nearly at final speed. This is done by reducing its gain to unity. When pulse width modulator 87 is enabled by the signal on lead 88 from logic circuit 20, its output is a pulse signal which has a pulse width that is proportional to the speed error signal. When motor 33 is below its set speed the width of the pulses output from modulator 87 increase, and visa versa when the speed of motor 33 is greater than it should be.

The variable width pulses output from pulse width modulator 87 operate current drive amplifier 89 to gate pulses of current to motor 33. There is a current sensing resistor 90 connected in series with amplifier 89 and a feedback voltage across this resistor is applied to pulse width modulator 87 via lead 91. Thus, the width of current pulses applied to motor 33 is regulated, and when the two DC voltages input to differential amplifier 85 are equal, motor 33 is at its set speed.

The control of motor 38 in second print mechanism 15 is basically done by a torque generator in which a DC voltage is converted to a constant current which produces a constant torque in motor 38, no matter what its speed. A precise reference voltage power supply has its output connected to a potentiometer 93 which is adjusted to provide an output voltage to set the desired torque of motor 38. The output voltage from potentiometer 93 is input to a summing circuit 94. There is a second voltage input to summing circuit 94 from the motor speed control circuitry described in the previous paragraphs for motor 33. This second input is a feedback signal that is derived from the output of differential amplifier 85 via potentiometer 95. A portion between five and fifty percent of the error signal output from modulator 85 is summed with the reference voltage from potentiometer 93 in summing circuit 94, and the sum is amplified by amplifier 96. The output of amplifier 96 is input to pulse width modulator 97. Modulator 97 operates the same as modulator 87 and provides output pulses having a pulse width proportional to the amplitude of the voltage at its input.

Modulator 97 also is controlled by a turn on signal from logic circuit 20 in FIG. 1 over lead 98. As previously described, control circuit first enables back tension motor 55 via a turn on signal on lead 103 in FIG. 1. Then power is applied to the drive motor in drive station 18. Thereafter, logic circuit provides a turn on signal on lead 98, FIG. 3, to enable modulator 97 to gate amplifier 99 to provide power to motor 38. Finally, control logic circuit 20 provides a turn on signal on lead 88 to modulator 87 as previously described.

When pulse width modulator 97 is enabled, it operates to gate pulses of current to motor 38. There is a current sensing resistor 100 connected in series with amplifier 99 and a feedback voltage across this resistor is applied to pulse width modulator 97 via lead 101.

Constant torque generator circuit 61 in FIG. 1 is alike the constant torque circuitry just described for motor 38 except that there is no feedback from the other motor control circuits, like elements 94 and 95, on FIG. 3. Accordingly, circuit 61 is not shown in any detail in any Figure and is not described any further. The turn on of circuit 61 is also controlled by control circuit via a signal on lead 102 for the sequence described two paragraphs back.

While what has been described hereinabove is the preferred embodiment of the invention, it should be understood that numerous changes may be made without departing from the spirit and scope of the invention. For example, while belt drives are taught in this specification, chain drives and gear train drives may be utilized instead.

What we claim is:

1. The combination comprising:

a roll of material mounted on a spindle, said roll of material being a source of a web;

a first intermediate work station means and a remote work station means, said work station means for performing operations on the web as it moves from the roll of material sequentially through the intermediate and remote work stations, movement of the web through the work stations being opposed by frictional forces;

first means for applying an active torque of controllable magnitude to the roll of material opposing movement of the web through the work stations;

second means for applying a second force to the web in the remote work station, said second force acting to move the web from its source through the work stations, the magnitude of the second force being less than the frictional forces opposing movement of the web;

third means for applying a third force to the web in the first intermediated work stations, said third force acting to move the web from its source through the work stations, the magnitude of the third force being greater than the forces acting on the web opposing such movement; and control means for varying the magnitude of the active torque applied to the roll of material and the magnitudes of the second and third forces to maintain the tension of the web from its source to the remote work station substantially constant and to move the web through the work stations at a substantially constant and predetermined speed.

2. The combination of claim 1 in which the roll of the material mounted on a spindle is a roll of paper having a radius, and the first means for applying a torque to the roll of paper includes an electric motor.

3. The combination of claim 2, in which the control means includes a circuit for varying electric power applied to the electric motor of the first means to vary the torque applied to the roll of paper as a function of the radius of the roll of paper to maintain the torque applied to the web substantially constant as the radius of the roll of paper on the spindle changes.

4. The combination of claim 1 in which there is a second intermediate work station, and fourth means for applying a fourth force to the web in the second intermediate work station said fourth force acting to move the web from its source through the work stations, the magnitude of the fourth force being less than that of the forces opposing such movement, and said control means controlling the magnitudes of the fourth force to maintain the tension of the web substantially constant.

5. The combination of claim 4 in which the third means for applying a force to the web in the first intermediate work station includes an electric motor and a paper speed sensor and motor torque circuit means for producing a speed signal which is a function of the speed of the web through said first intermediate work station, said control means responsive to said speed signal varying the electric power applied to said electrical motor as a function of the speed of the paper through said first intermediate work station to maintain said speed substantially constant.

6. The combination of claim 5 further including control means for energizing in the following order;

1. the first means for applying an active torque to the roll of paper;
2. the second means for applying a force to the web in the remote work station;
3. the fourth means for applying a force to the web in the second intermediate work station; and
4. the third means for applying the third force to the web in the first intermediate work station.

7. The combination of claim 5 in which the intermediate work stations are printing mechanisms.

8. A printer comprising:

a roll of paper mounted on a spindle, said roll of paper being the source of a paper web to which print is to be applied;

means for applying an active torque to the roll of paper opposing movement of the web through the printer;

a printing station through which the web moves, said printing station including an electric motor for applying a force to the web;

circuit means for applying power to the electric motor of the printing station sufficient to move the web through the printing station;

a work station through which the web moves for perforating, punching, and cutting the web into sheets, said work station including an electric motor for applying a force to the web;

circuit means for applying power to the electric motor of the work station, the magnitude of the power supplied being less than that required to overcome the forces opposing movement of the web through the work station; and control means for controlling the torque applied to the roll of paper and the power applied to the electric motors of the the printing station and work station to maintain the tension on the web from the roll of paper through the printing station and the work station substantially constant as the web moves through said stations at a substantially constant speed.

9. The method of maintaining at desired values the tension and speed of a paper web from a roll of paper moving through a printer having a printing station and a work station, the work station being the last station of the printer through which the paper web moves, there being an electric motor operatively connected to the supply roll, an electric motor operatively connected to the web in the printer station, and an electric motor operatively connected to the web in the work station; said method comprising the steps of:

providing power to the electric motor operatively connected to the roll of paper to apply an active torque to the roll of paper opposing movement of the web through the printer;

providing power to the motor operatively connected to the web in the work station to apply a first force to the web acting in a direction to move the web through the printer from the roll of paper through the work station, and first force being less than forces acting on the web opposing such movement;

providing power to the motor of the printing station operatively connected to the web in the printing station to apply a second force acting in the same direction as the first force, the magnitude of the second force moving the web through the printer at a predetermined and substantially constant speed; and controlling the power applied to the electric motors to maintain the tension of the web substantially constant and the speed of the web through the printer at a predetermined substantially constant speed.

10. The method of claim 9 further comprising the step of:

controlling the power applied to the motor operatively connected to the roll of paper, said roll of paper having a radius, to maintain the force applied to the web substantially constant as the radius of the roll of paper decreases.

11. The method of claim 10 further comprising the steps of:

providing an indication of the speed of the web moving through the printing station; and controlling the power provided to the motor operatively connect to the web moving through the printing station to maintain the speed of the web substantially at said predetermined speed.

* * * * *